United States Patent [19]

Mathou

[11] 4,433,447

[45] Feb. 28, 1984

[54] PLAY PEN

[76] Inventor: Marcel Mathou, 12630, Gages, France

[21] Appl. No.: 374,024

[22] Filed: May 3, 1982

[30] Foreign Application Priority Data

May 6, 1981 [FR] France ..... 81 09041

[51] Int. Cl.[3] ..... E03D 11/10

[52] U.S. Cl. ..... 5/93 R; 5/99 C; 256/25

[58] Field of Search ..... 256/25, 26; 5/93 R, 5/99 C, 99 B, 98 R; 403/223, 220

[56] References Cited

U.S. PATENT DOCUMENTS 2,810,554 10/1957 Blazey ..... 256/25

4,208,037 6/1980 Legal ..... 256/25

4,285,609 8/1981 Runyon ..... 403/220 X

FOREIGN PATENT DOCUMENTS 570507 7/1945 United Kingdom ..... 256/25

*Primary Examiner*—Andrew V. Kundrat

*Attorney, Agent, or Firm*—Cushman, Darby & Cushman

[57] ABSTRACT

The play pen of the invention has a body including a peripheric frame formed of parallel side-members and extending between corner posts (4), each side-member including a rigid core which is covered by a flexible plastic tube extending beyond the core ends and fixed (at 9) to posts (4) in order to ensure a flexible connection between the latters and the various side-members. Each post advantageously includes a pair of damping elements (12) and (13) the floor (5) being floatingly fitted on the lower damping element 13.

9 Claims, 2 Drawing Figures

PLAY PEN

FIELD OF THE INVENTION

The present invention concerns furniture structures relating to games and, more specially, a play pen for use by young children.

Safety is of prime importance and should be taken into account when useful or relating to games equipment for use by young children is concerned. As a consequence of safety measures, maintaining a good mechanical behaviour during the life of such an equipment should be particularly sought for with a view to limit as far as possible dangers for children, notwithstanding the somewhat destructive behaviour now and then shown by the latter. Such considerations more specially apply to game structures of intensive use by children, and further more specially for non static games.

The present invention provides a play pen for young children, featuring flexibility and strength, greatly limiting damage risks, and capable of supporting any impact, not only as far as the even play pen structure is concerned, but also for any child inside the play pen, specially should said play pen run against fixed or movable obstacles.

BRIEF SUMMARY OF THE INVENTION

To this end, the play pen of the present invention includes a wheeled body formed of a peripheric frame having side-members extending between corner posts, with each side-member end connected to a post through a flexible element.

According to another feature of the invention, said frame includes, for each body face, a pair of parallel side-members, with each side-member including a solid core covered by a plastic material tube, the portions extending beyond the core ends thereof forming the elements connecting said side-member to the posts which it subtends.

This arrangement provides a body structure having a rigid shape but showing some deflection flexibility, imparting vibration or impact damping effect, whether said vibration or impact originates from inside or outside the play pen, specially owing to a child sitting in said play pen.

According to another feature of the invention, the play pen body is triangularly shaped, the wheels thereof being assembled at the triangle corner post level.

Said arrangement imparts to the play pen remarkably increased deflection and stability features, specially making it very difficult to tilt.

One way of carrying out the invention is described in detail below with reference to drawings which illustrate only one specific embodiment in which:

DETAILED DESCRIPTION OF THE PREFERRED EMBODIMENTS

Figure 1:
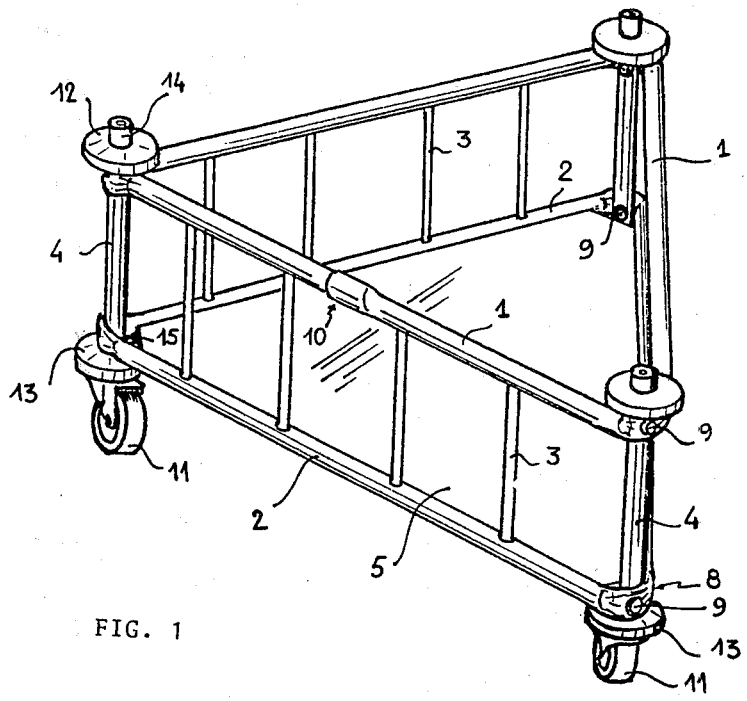
FIG. 1 is a perspective schematic view showing a play pen according to the invention.

The play pen according to the invention illustrated in FIG. 1 includes a peripheric body comprising, for each face, a pair of upper 1 and lower 2 side-members, mutually parallel, which are connected by small bars 3, thereby giving the overall structure the shape of a ladder. Side-members 1 and 2 are connected at the opposed ends thereof to upright posts 4, defining the body polygone corners, advantageously a triangle. Said body is completed by a floor 5 at the level of lower side-members 2.

Figure 2:
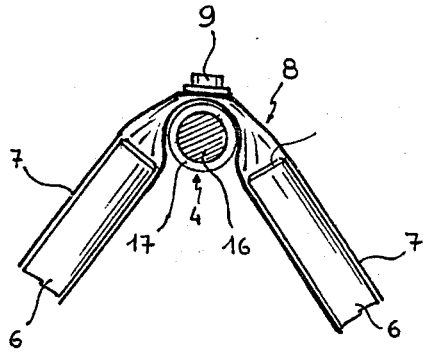
FIG. 2 is a plan view of a flexible connecting element between side-members and a body post.

As is clearly apparent from FIG. 2, according to the invention, each side-member 1,2 includes a core 6, advantageously made of wood, preferably having the shape of a cylinder. Said core 6 is covered by a plastic tube 7, with an internal diameter slightly greater than the external diameter of cores 6. The overall length of each core 6 is slightly less than the distance between two posts 4 which are subtended by the corresponding side-member, said side-member being fixed to post 4 by portions 8 of covering tube 7 extending beyond core 6 ends, said extended portions 8 being forcibly flattened against the external periphery of post 4 and connected to the latter by a screw and washer assembly 9 having an axis substantially identical with the bisectrix between two adjacent side-members. In a preferred embodiment of the invention illustrated in FIG. 1, successive upper 1 and lower 2 side-members include three wooden webs, having a diameter of about 30 mm, covered by a single flexible plastic material tube but showing some stiffness, e.g. made of about 4 mm thick polyvinyl material, the opposed ends of said tube being butt jointed around a spacer ring or fitted together, as shown at 10, in order to obtain a complete covering of the whole frame formed of said side-members, the so-obtained assembly being shaped by slightly heating said covering tube. As is clearly apparent from FIG. 2, one will understand that the tube regions between two successive cores 6 provide said portions 8 connecting side-members to post 4, ensuring a flexible connection between the latters and the post according to a specially simple and efficient arrangement, with the covering tube 7 further imparting a damping effect along the full length of side-members 1 or 2; said posts 4 themselves include a metal or wood cylindrical core 16 covered with a plastic sheath 17 as is the case for small bars 3.

The play pen of the invention is fitted with freely pivoting 11, which are attached to post 4 lower ends. Because said play pen is subject to frequently impinge various objects, according to a special feature of the invention, each side-member includes a pair of upper and lower damping elements 12 and 13, respectively, of flattened cylindrical shape, both outwardly and inwardly protruding from a corresponding corner of the body and advantageously made of flexible or semi-rigid plastic material. Said upper damping elements 12 are fixed on the upper ends of posts 4 through other smaller diameter cylindrical damping elements 14.

According to another feature of the invention, with a view to further improve the flexibility and the damping effects of the play pen, floor 5 includes a flat element provided, on the lower face and along the sides thereof, with stiffening and support slats, simply bearing on the internal protruding parts of said damping elements 13, whereby floor 5 is floating on said body. Notwithstanding some flexibility should an impact occur, the body structure of the play pen according to the invention has a rigid construction that practically will not lose its shape, even after a long and severe usage period.

While this invention has been described in conjunction with a specific embodiment thereof, it is evident that many alternatives, modifications and variations will be apparent to those skilled in the art. Particularly, instead of the extended portions of covering tubes, the flexible connections with side-members and posts can be realized by any other similar means.

What I claim is:

1. A play pen including a peripheric frame formed of corner posts and side-members extending between said corner posts, wheels mounted at the bottom of said frame, and hollow flexible elements connecting said side-members to said posts, each of said connecting elements having end portions fitted on adjacent side-members and a medium portion secured to one of said posts by securing means flattening said medium portion against said post.

2. A play pen as recited in claim 1, wherein each corner post includes at least a damping element outwardly protruding from the corresponding body corner.

3. A play pen as recited in claim 2, wherein said damping element includes a portion protruding internally into said frame, said frame including a floor disposed on said internally protruding portion.

4. A play pen as recited in claim 1, wherein said frame includes, for each face, a pair of said parallel side-members (1,2) connected by small intermediate bars (3).

5. A play pen as recited in claim 4, wherein said side-member (1,2) includes a core (6) covered by a plastic material tube (7) extending beyond said core ends and constituting said connection element (8) to posts (4).

6. A play pen as recited in claim 5, wherein said successive side-members (1,2) are covered with the same polyvinyl material tube (7), the length of each side-member being less than the distance between both posts (7) which it subtends.

7. A play pen as recited in claim 6, wherein said covering tube (7) has a thickness of about 4 mm.

8. A play pen as recited in claim 1, wherein said frame is triangularly shaped, said wheels being fitted at right angles with said corner posts (4).

9. A play pen as recited in claim 2, wherein said post (4) each includes a pair of upper (12) and lower (13) cylindrical damping elements, said pen including a floor (5) which floatingly bears upon said lower damping element (13).

* * * * *